United States Patent [19]

Powers, Jr.

[11] 4,251,965

[45] Feb. 24, 1981

[54] MODULAR WALL SECTION

[76] Inventor: John A. Powers, Jr., 4118 E. Elwood, Phoenix, Ariz. 85040

[21] Appl. No.: 30,129

[22] Filed: Apr. 16, 1979

[51] Int. Cl.[3] ..... E04B 2/00

[52] U.S. Cl. ..... 52/289; 52/262; 52/265

[58] Field of Search ..... 52/90, 92, 262, 264, 52/265, 802, 803, 274, 293, 285, 289

[56] References Cited

U.S. PATENT DOCUMENTS

| | | | |
|---|---|---|---|
| 817,509 | 4/1906 | Niele | 52/90 |
| 2,023,814 | 12/1935 | Lindsey | 52/90 |
| 2,050,609 | 8/1936 | Howell | 52/274 |
| 2,688,109 | 8/1954 | Holland | 52/262 |
| 2,832,445 | 4/1958 | Burgin | 52/762 |
| 3,053,354 | 9/1962 | Dielman | 52/122 |
| 3,054,481 | 9/1962 | Johnson | 52/293 |
| 3,055,460 | 9/1962 | Maroney | 52/293 |
| 3,305,989 | 2/1967 | Scott | 52/730 |
| 3,675,379 | 7/1972 | Lambert | 52/274 |

FOREIGN PATENT DOCUMENTS

| | | | |
|---|---|---|---|
| 77860 | 10/1948 | Norway | 52/92 |

*Primary Examiner*—Price C. Faw, Jr.
*Assistant Examiner*—Henry E. Raduazo
*Attorney, Agent, or Firm*—Don J. Flickinger

[57] ABSTRACT

Side panels, terminating with inwardly directed flanges extend from the vertical edges of an upright main panel to form a generally channel shaped unit. The lower edge of each side panel is spaced above the lower edges of the main panel and the flanges to receive a conventional sill. A bearing plate extends inwardly from the lower edge of each side panel to rest upon the top of the sill. The upper edges of the side panels and the flanges terminate below the upper edge of the main panel to form a ledge for supporting a conventional beam. A recess, formed in the upper corner of the main panel, accommodates the beam and has a beam attachment plate extending therefrom.

7 Claims, 6 Drawing Figures

MODULAR WALL SECTION

This invention relates to building construction.

More particularly, the present invention relates to modular sections for the fabrication of building walls.

In a further aspect, the instant invention concerns a modular wall section which can be used with conventional construction sills and beams.

The advantages of modular building units are well established. Pre-fabricated in a factory utilizing mass production technology, the modular units can be produced more quickly and economically than is possible with field construction techniques. Generally, the strength and dimensional tolerances also exceed field constructed products. At the site of construction, modular units can be erected with minimal time and skills representing substantial savings to the consumer.

The prior construction and building art is replete with various modular units and systems. A recent search of records within the United States Patent and Trademark Office revealed the following issued United States Patents which pertain to the instant subject:

U.S. Pat. No. 2,832,445 Burgin
U.S. Pat. No. 2,981,034 Burgin
U.S. Pat. No. 3,662,507 Espeland
U.S. Pat. No. 3,507,084 Jay et al
U.S. Pat. No. 2,023,814 Lindsey
U.S. Pat. No. 3,127,960 Smith et al
U.S. Pat. No. 3,304,675 Wood et al Various modular wall sections are illustrated within the references. Of the several references, U.S. Pat. No. 2,023,814 is considered to be most pertinent to the instant invention. Illustrated is a modular wall section being generally channel shaped in cross-section, as seen in FIG. 2 and having upper and lower ends, as specifically illustrated in FIGS. 7 and 8, respectively. It is noted that the wall section is specifically fabricated to cooperate with especially fabricated floor, ceiling and roof sections.

The text instructs that "The flooring may be placed on any suitable foundation" (Col. 2, ln. 18). As illustrated in FIG. 1, the wall sections rest upon a foundation including a sill. However, the reference does not contain any teachings or suggestions of interactions between the wall sections and the sill, nor a means of attaching the wall sections to the sill.

U.S. Pat. No. 3,304,675, in FIG. 5, also illustrates a modular wall section, which is generally channel shaped in cross-section. As seen in FIG. 6, wall sections are secured to the foundation, without sill, by a channel shaped member. Other typical special structures used to secure the wall sections to the foundation are clearly illustrated in FIG. 4 of U.S. Pat. No. 2,832,445 and FIG. 4 of U.S. Pat. No. 3,127,960.

It is apparent from the foregoing references that the prior art does not anticipate the utilization of prefabricated wall sections with conventional sills. The attachment of beams is similarly treated by the prior art. U.S. Pat. No. 3,507,084 provides for the use of a conventional beam, however, the beam is supported by a column which is positioned between adjacent wall sections.

In many instances, it is desirable to provide a pre-fabricated wall section with conventional construction techniques, including conventional sills and beams. The inability of the prior art to provide such a pre-fabricated wall section, is considered a deficiency thereof.

Accordingly, it is an object of the present invention to provide an improved modular wall section.

Another object of the invention is the provision of a modular wall section which can be integrated with standard construction techniques and materials.

And, another object of the invention is to provide a modular wall section which is usable with conventional foundations and sills.

Still another object of the invention is to provide a modular wall section which is self-aligning with a standard sill.

Yet another object of this invention is to provide a modular wall section having improved means for attachment to a sill.

And, yet another object of the invention is the provision of an improved modular wall section which will accept and support a conventional ceiling beam.

A further object of the invention is to provide a modular wall section which is readily fabricated from a single sheet of rigid material.

And a further object of the invention is the provision of a modular wall section which can be directly finished or alternately, can have various facings applied thereto.

Yet a further object of the invention is to provide an improved modular wall section which can be joined to an adjacent similar panel with conventional fastening elements without the need for special brackets or joining members.

And yet a further object of the invention is the provision of an improved modular wall section of the above type which is simply and economically manufactured.

Briefly, to achieve the desired objects of the instant invention, the improved modular wall section, in accordance with a preferred embodiment thereof, is generally channel shaped in cross-section. The channel shaped structure includes a main panel having side panels along either vertical edge which terminate with inwardly directed flanges. Means are provided at the bottom of the wall section for accommodating a conventional foundation sill.

The means for accommodating the sill include spacing the flanges from the main panel a distance equal to the width of the sill. The lower edges of the side panels are spaced above the lower edges of the flanges in the main panel a distance equal to the height of the sill. Accordingly, the wall section may be placed over and aligned with the sill. Apertures, extending through the lower portions of the flanges and the main panel, accommodate conventional fastening elements which are secured into the sill. Additionally, a bearing plate may extend inwardly from the lower edge of each side panel for bearing upon the sill.

The upper edges of the side panels and the flanges are spaced below the upper edge of the main panel a distance corresponding to the height of a conventional ceiling beam and form a ledge upon which the beam rests. A recess formed in the upper corner of the main panel is sized and shaped to receive the beam therethrough. An attachement plate extends from the vertical edge of the recess and has apertures therethrough for conventional fastening elements which are secured into the beam. Preferably, the width of the recess is one-half the width of the beam, whereby the beam is supported by a pair of adjacent panels.

The foregoing and further and more specific objects and advantages of the instant invention will become readily apparent to those skilled in the art from the following detailed description of a preferred embodiment of the invention, taken in conjunction with the drawings, in which.

Figure 1:
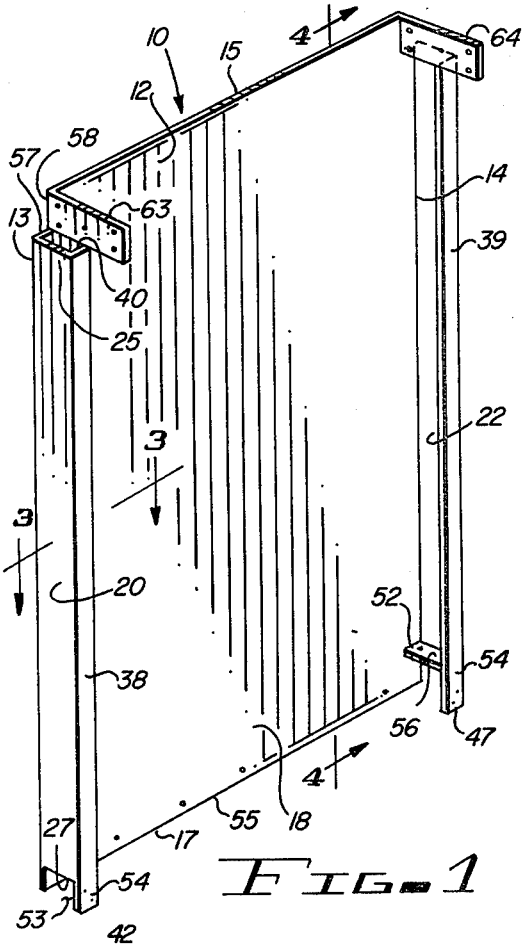
FIG. 1 is a perspective view taken from the inner side of a modular wall panel constructed in accordance with the teachings of the instant invention.

Turning now to the drawings, in which like reference characters indicate corresponding elements throughout the several views, attention is first directed to FIG. 1 which shows a modular wall section embodying the principals of the instant invention and generally designated by the reference character 10. Modular wall section 10 includes a main panel 12, having a pair of spaced apart vertical edges 13 and 14, upper and lower lateral edges 15 and 17, respectively, inner surface 18 and outer surface 19, the latter being better seen in FIG. 2.

Side panels 20 and 22 extend angularly from main panel 12. Side panel 20, in general similarity to main panel 12, includes vertical edges 23 and 24, upper and lower lateral edges 25 and 27, respectively, and inner and outer surfaces 28 and 29, respectively. Similarly, side panel 22 includes vertical edges 30 and 32, upper lateral edge 33, lower lateral edge 34 and inner and outer surfaces 35 and 37, respectively.

Side panels 20 and 22 are positioned at respective vertical edges of main panel 12, vertical edge 23 of panel 20 being coincident with vertical edge 13 of main panel 12, and vertical edge 30 of side panel 22 being coincident with vertical edge 14 of main panel 12. In the immediately preferred embodiment of the invention, as illustrated, panels 20 and 22 are parallel, each being perpendicular to main panel 12. When used to erect an exterior wall, it is anticipated that outer surface 12 will actually be positioned to the exterior side of the building. However, panel 10 may be placed either way and the terms "inner" and "outer" as used herein are for reference purposes only and refer to the orientation of the elements relative the entire wall section.

Figure 3:
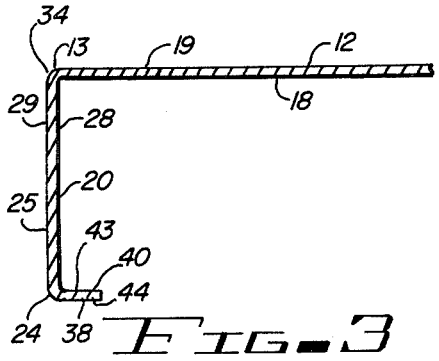
FIG. 3 is an enlarged fragmentary horizontal sectional view taken along the line 3—3 of FIG. 1.

Vertical edges 23 and 30 are considered the first vertical edges of panels 20 and 22, respectively, while edges 24 and 32 are considered the second vertical eges of side panels 20 and 22, respectively. A pair of inwardly directed flanges 38 and 39 extend along vertical edges 24 and 32, respectively. Flange 38 includes upper lateral edge 40, lower lateral edge 42 and inner and outer surfaces 43 and 44. Correspondingly, flange 39 includes upper lateral edge 45, lower lateral edge 47 and inner and outer surfaces 48 and 49. The relationship amoung main panel 12, side panel 20 and flange 38 is clearly illustrated in FIG. 3. The relationship involving side panel 22 and flange 39 is a mirror image thereof.

Figure 4:
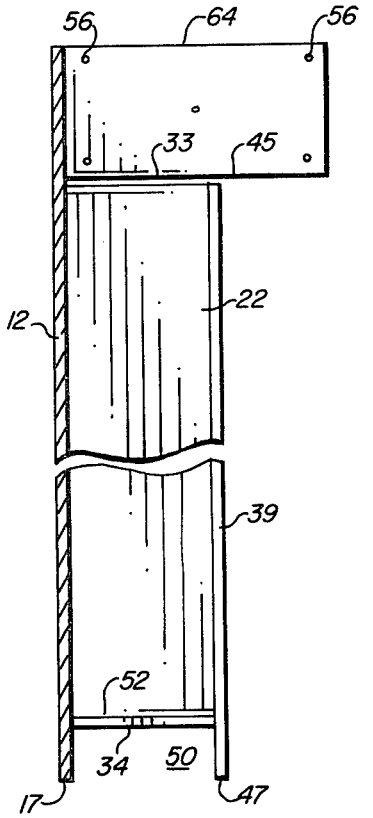
FIG. 4 is an enlarged fragmentary vertical sectional view taken along the line 4—4 of FIG. 1.

As illustrated in FIGS. 1 and 4, the lower lateral edges 17 and 47 of main panel 12 and flange 39, respectively, terminate in the same plane. Lower lateral edge 34 of side panel 22 is spaced above edges 17 and 47. Opening 50 is thus formed in panel 10. Bearing plate 52 extends inwardly from edge 34 between panel 12 and flange 39 above opening 50. A similar arrangement and bearing plate (although not specifically herein illustrated), is associated with side panel 20 as indicated by opening 53. A plurality of apertures 54 extend through the bearing plates and the lower portions of main panel 12 and flanges 38 and 39. The bearing plates and the apertures will be described in further detail presently.

Figure 2:
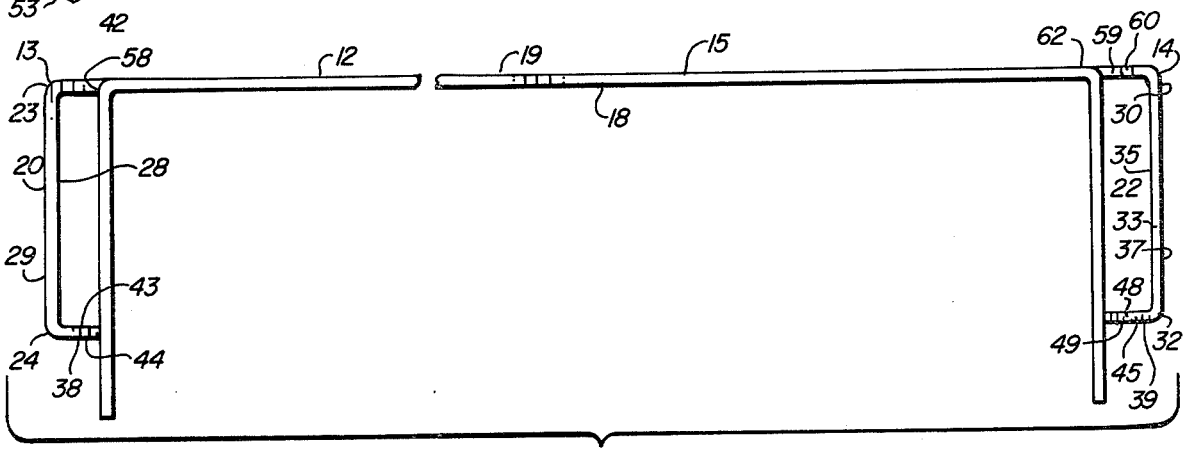
FIG. 2 is an enlarged top plan view, partly broken away, of the modular wall section of FIG. 1.

With reference to FIGS. 1, 2 and 4, it is seen that the upper lateral edges 25 and 40 of side panel 20 and flange 38, respectively, and the upper lateral edges 33 and 45 of side panel 22 and flange 39, respectively, reside below the upper lateral edge 15 of main panel 12. A recess 55, as defined by horizontal edge 57 and vertical edge 58 is formed at the juncture of vertical edge 13 and upper lateral edge 15 of panel 12. The horizontal edge 57 lies in the plane of upper lateral edges 25 and 40 of side panel 20 and flange 38, respectively. Similarly, recess 59 is formed at the juncture of vertical edge 14 and upper lateral edge 15 of panel 12 by horizontal edge 60 and vertical edge 62. Attachment plates 63 and 64, each having further apertures 54 therethrough, extend from vertical edges 58 and 62 of recesses 55 and 59, respectively. The foregoing will also be explained in further detail hereinafter.

Figure 5:
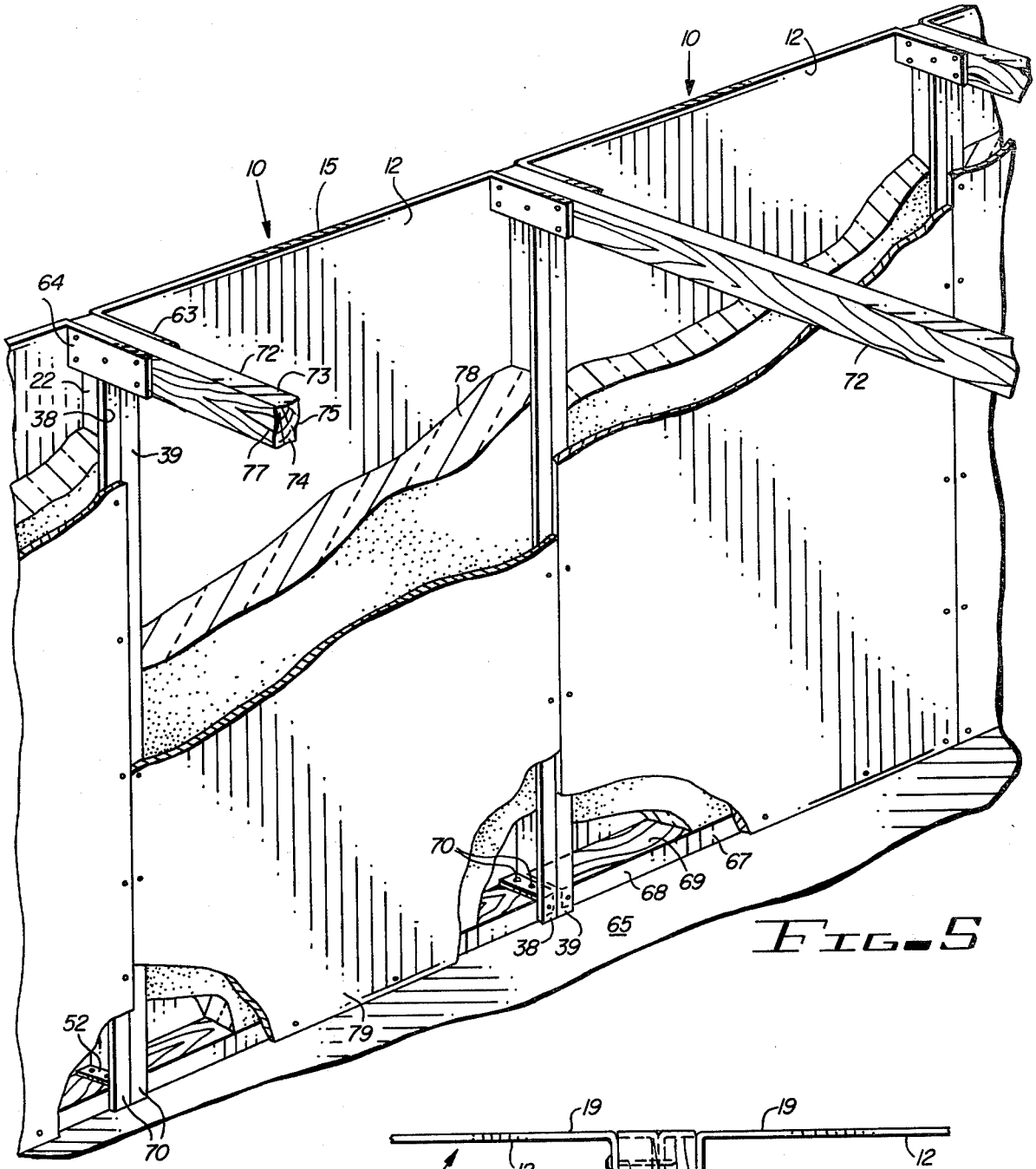
FIG. 5 is a fragmentary perspective view of a completed wall utilizing a plurality of the modular wall sections, as seen in FIG. 1.

A conventional building foundation generally includes a concrete base to which are secured sills at locations where interior and exterior walls are to be erected. Typically, the sill is a length of standard dimensioned lumber, usually a two-by-four. FIG. 5 illustrates an exemplary foundation having concrete base 65 and sill 67. As positioned, sill 67 has a pair of spaced apart sides 68 (only one side 68 is seen herein) and a top surface 69. The height of sill 68 is determined by the height of sides 68. The width of sill 67 is determined by the distance between sides 68.

A conventional foundation, as viewed in FIG. 5, readily accepts and supports modular wall panels 10 of the instant invention. Openings 50 and 53 are sized and shaped to receive sill 67. Lower edges 27 and 34 of side panels 20 and 22, respectively, are positioned above the lower lateral edges 54 of main panel 12, 42 of flange 38 and 47 of flange 39, a distance corresponding to the height of sill 67. The distance between the inner surfaces 43 and 48 of flanges 38 and 39, respectively, and the inner surface 18 of main panel 12 corresponds to the width of sill 67. Bearing plates 52 rest upon top surface 69 of sill 67. Conventional fastening elements, such as nails 70, are passed through the several apertures 54 and secured into sill 67.

As is apparent from the above description, each modular wall panel 10 is automatically aligned by, and readily fastened to, sill 67. Side panels 20 and 22 of adjacent sections 10 are abutted. Additional apertures 54 extending through the panels 20 and 22 accommodate rivets, screws or other conventional fastening elements for adjoining adjacent sections.

Figure 6:
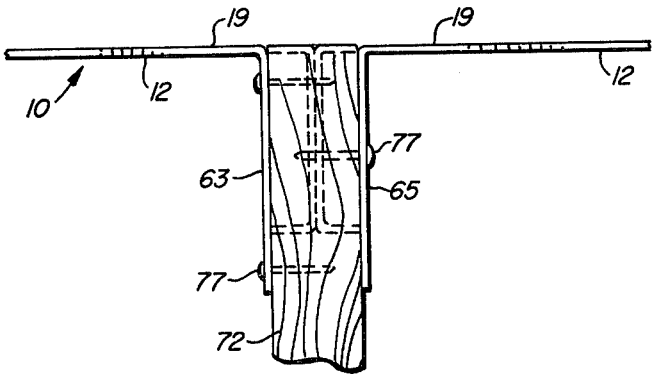
FIG. 6 is an enlarged top plan view of a portion of the wall of FIG. 5, especially detailing the attachment of a ceiling beam.

As further seen in FIG. 6, a beam 72 is supported at the upper corner of each section 10. Beams 72, which may also be referred to as rafters, are conventional construction components, typically standard dimensioned lumber such as two-by-four or two-by-six. Upper lateral edges 33 and 34 of side panel 22 and flange 39, respectively, and upper lateral edges 25 and 40 of side panel 20 and flange 38, respectively, form a ledge upon which each beam 72 rests.

Beam 72 has a height determined by the distance between upper and lower surfaces 73 and 74, respectively, and a width which is determined by the distance between side surfaces 75 and 77. In order that the top surface 73 of beam 72 is flush with the top of each panel 10, edges 25, 40, 33 and 45 are spaced below the upper lateral edge 15 of main panel 12 a distance corresponding to the height of beam 72. Vertical edge 58 of recess 55 is spaced from outer surface 29 of side panel 20 a distance corresponding to one-half the width of beam 72. Similarly, vertical edge 62 of recess 59 is spaced from outer surface 37 of side panel 22 a distance corresponding to one-half the width of beam 72. Accordingly, each beam 72 is partially supported by each adjacent modular wall section 10. Being attached to vertical edges 58 and 62, attachment plates 63 and 65, respectively, are spaced to receive beam 72 therebetween. Nails 77, or other conventional fastening elements, such as bolts or screws, are passed through the apertures 54 in attachment plates 63 and 65 to secure each beam 72 to the wall structure. As seen in FIG. 6, beam 72 terminates flush with the outer surfaces 19 of adjacent main panels 12. In accordance with conventional practice, beam 72 may extend beyond panels 10 for the attachment of rafters or to form an overhang.

Various changes and modifications to the embodiment herein chosen for purposes of illustration will readily occur to those skilled in the art. For example, while it has been specifically shown that the beam is partially supported by each adjacent panel, it is within the spirit of the invention that each modular wall section be provided with self-contained means for supporting a beam. Similarly, if it is not desired to support beams, the beam support means may be eliminated from the modular wall section. Materials of construction and dimensions are at the discretion of those skilled in the art. Determining factors are desired ceiling height, selection of sills and beams, and convenience of handling. A section measuring approximately four feet by eight feet is envisioned.

The specific embodiment of the invention as illustrated is radily fabricated from a single sheet of metallic material, such as steel or aluminum. It is also anticipated that the section can be fabricated as a weldment, or molded from a suitable plastic. The strength of the material, as will be appreciated by those skilled in the art, is determined by the intended use, such as erecting an inhabitable building or a storage shed. The exterior surface of the section, if desired, can be variously treated by applying various surface coatings such as paint or alternately, attaching a facing such as conventional siding or masonry products. As seen in FIG. 5, each section 10 may be filled with a conventional insulative material 78 and finished with an appropriate conventional wall board or sheeting 79.

Various other modifications and variations to the embodiment herein chosen for purposes of illustration will readily occur to those skilled in the art. To the extend that such modifications and variations do not depart from the spirit of the invention, they are intended to be included within the scope thereof, which is assessed only by a fair interpretation of the following claims.

Having fully described and disclosed the invention in such clear and concise terms as to enable those skilled in the art to understand and practice the same, the invention claimed is:

1. A modular construction wall section for bearing upon and securement to a conventional sill, which sill includes:

a pair of spaced apart side surfaces of predetermined height, and a top surface, and for forming a wall of a building, said wall section comprising:

a. an upright main panel having,
   i. a pair of spaced apart vertical edges,
   ii. upper and lower lateral edges extending between said pair of vertical edges, and
   iii. inner and outer surfaces;

b. a pair of side panels extending angularly from said main panel, each said side panel having
   i. a first vertical edge coincident with a respective vertical edge of said main panel,
   ii. a second vertical edge spaced from said first vertical edge a distance corresponding to the distance between the sides of said sill, and
   iii. an upper lateral edge, and
   iv. a lower lateral edge spaced above the lower lateral edge of said main panel a distance of the sides of said sill;

c. a pair of inwardly directed flanges, one of said flanges extending along the second vertical edge of each of said side panels; and d. further including a ledge for receiving thereon the lower edge of a beam having spaced apart upper and lower edges and spaced apart vertical edges, said ledge being defined by the upper lateral edge of a said side panel and the respective said flange being spaced below the upper lateral edge of said main panel a distance corresponding to the distance between the upper and lower edges of said beam.

2. The wall section of claim 1, further including a bearing plate extending inwardly from the lower lateral edge of each of said pair of side panels for abuttment on the top surface of said sill.

3. The wall section of claim 2, further including apertures through said main panel, said flanges, and said bearing plates for receiving fastening elements therethrough, which fastening elements are secured into said sill.

4. The wall section of claim 1, further including a recess formed in said main panel for receiving said beam, said recess defined by a horizontal edge lying in the plane of the upper lateral edges of said side panels and said flanges and a vertical edge extending between said horizontal edge and said upper lateral edge of said main panel.

5. The wall section of claim 4, further including an attachment plate extending from the vertical edge of said recess over the upper lateral edges of said side panel and said flange for receiving a side of said beam therethrough.

6. The wall section of claim 5, further including an aperture through said attachment plate for receiving a beam attachment element therethrough.

7. The wall section of claim 4, wherein the vertical edge of said recess is spaced from the respective vertical edge of said main panel a distance corresponding to approximately one-half the distance between the vertical sides of said beam.

* * * * *